US012680048B2

(12) United States Patent
Shi

(10) Patent No.: US 12,680,048 B2
(45) Date of Patent: Jul. 14, 2026

(54) ONE-STEP PRETREATMENT METHOD OF METALLIC SUBSTRATES FOR METAL COLD FORMING

(71) Applicant: CHEMETALL GMBH, Frankfurt (DE)

(72) Inventor: Yinfeng Shi, Frankfurt am Main (DE)

(73) Assignee: CHEMETALL GMBH, Frankfurt am Main (DE)

( * ) Notice: Subject to any disclaimer, the term of this patent is extended or adjusted under 35 U.S.C. 154(b) by 267 days.

(21) Appl. No.: 17/802,189

(22) PCT Filed: Feb. 25, 2021

(86) PCT No.: PCT/EP2021/054655
§ 371 (c)(1),
(2) Date: Aug. 25, 2022

(87) PCT Pub. No.: WO2021/170706
PCT Pub. Date: Sep. 2, 2021

(65) Prior Publication Data

US 2023/0106175 A1 Apr. 6, 2023

(30) Foreign Application Priority Data

Feb. 25, 2020 (EP) ..... 20159322

(51) Int. Cl.

| | |
|---|---|
| ***C10M 169/04*** | (2006.01) |
| ***B21D 37/18*** | (2006.01) |
| ***C10M 101/02*** | (2006.01) |
| ***C10M 107/02*** | (2006.01) |
| ***C10M 107/42*** | (2006.01) |
| ***C10M 111/04*** | (2006.01) |
| ***C10M 125/24*** | (2006.01) |
| ***C10M 129/34*** | (2006.01) |
| ***C10M 141/02*** | (2006.01) |
| *C10N 20/04* | (2006.01) |
| *C10N 30/12* | (2006.01) |
| *C10N 40/20* | (2006.01) |

(52) U.S. Cl.
CPC ..... *C10M 169/04* (2013.01); *B21D 37/18* (2013.01); *C10M 101/025* (2013.01); *C10M 107/02* (2013.01); *C10M 107/42* (2013.01); *C10M 111/04* (2013.01); *C10M 125/24* (2013.01); *C10M 129/34* (2013.01); *C10M 141/02* (2013.01); *C10M 2201/085* (2013.01); *C10M 2205/143* (2013.01); *C10M 2205/163* (2013.01); *C10M 2207/123* (2013.01); *C10M 2217/0285* (2013.01); *C10N 2020/04* (2013.01); *C10N 2030/12* (2013.01); *C10N 2040/243* (2020.05); *C10N 2040/246* (2020.05)

(58) Field of Classification Search
CPC ..... C10M 169/04; C10M 101/025; C10M 107/02; C10M 107/42; C10M 111/04; C10M 125/24; C10M 129/34; C10M 141/02; C10M 2201/085; C10M 2205/143; C10M 2205/163; C10M 2207/123; C10M 2217/0285; C10M 113/00; C10M 2201/0853; C10M 2205/183; C10M 2207/1233; B21D 37/18; C10N 2020/04; C10N 2030/12; C10N 2040/243; C10N 2040/246; C10N 2050/025
See application file for complete search history.

(56) References Cited

U.S. PATENT DOCUMENTS

| | | | | |
|---|---|---|---|---|
| 4,289,546 | A | 9/1981 | Hacias | |
| 8,541,350 | B2 | 9/2013 | Kirsch et al. | |
| 9,422,503 | B2 | 8/2016 | Rau et al. | |
| 2004/0151619 | A1 | 8/2004 | Quellhorst et al. | |
| 2010/0285323 | A1* | 11/2010 | Kirsch | C10M 173/02 427/388.5 |

FOREIGN PATENT DOCUMENTS

| | | | |
|---|---|---|---|
| CN | 101932686 | A | 12/2010 |
| CN | 105862424 | A | 8/2016 |
| CN | 105907308 | A | 8/2016 |
| JP | 54005847 | * | 1/1979 |
| JP | S5672090 | A | 6/1981 |
| WO | 2006108657 | A1 | 10/2006 |

OTHER PUBLICATIONS

International Search Report and Written Opinion for PCT/EP2021/054655 issued on May 4, 2021, 10 pages.

* cited by examiner

*Primary Examiner* — Cephia D Toomer
(74) *Attorney, Agent, or Firm* — Armstrong Teasdale LLP

(57) ABSTRACT

Disclosed herein is a method for pretreatment of a metallic substrate for a subsequent metal cold forming process, said method including providing at least one substrate, and contacting at least one surface of the substrate with an aqueous lubricant composition (B). The aqueous lubricant composition (B) has a pH value in the range of from 0.1 to 6.0, and includes water in an amount of at least 40 wt.-%, based on the total weight of composition (B), at least one film-forming polymer, at least one wax, at least one corrosion inhibitor, and oxalate and/or phosphate anions. Further disclosed herein are a pretreated metallic substrate obtainable by the aforementioned inventive method, a method of cold forming of a metallic substrate including a step of subjecting the inventive pretreated metallic substrate to a cold forming process, an aqueous lubricant composition (B), and a master batch for preparing the aqueous composition (B).

20 Claims, No Drawings

ONE-STEP PRETREATMENT METHOD OF METALLIC SUBSTRATES FOR METAL COLD FORMING

CROSS-REFERENCE TO RELATED APPLICATIONS

This application is a U.S. National Phase Application of International Patent Application No. PCT/EP2021/054655, filed Feb. 25, 2021, which claims priority to European Patent Application No. 20159322.5, filed Feb. 25, 2020, each of which is hereby incorporated by reference herein.

The present invention relates to a method for pretreatment of a metallic substrate for a subsequent metal cold forming process, said method comprising at least steps (1) and (2), namely providing at least one substrate having at least one surface at least partially made of at least one metal (step (1)), contacting the at least one surface of the substrate provided in step (1) with an aqueous lubricant composition (B) (step (2)), wherein the aqueous lubricant composition (B) has a pH value in the range of from 0.1 to 6.0, comprises water in an amount of at least 40 wt.-%, based on the total weight of composition (B), at least one film-forming polymer (b1), which is a homopolymer and/or copolymer being prepared by polymerization of at least vinyl pyrrolidone, wherein said homopolymer and/or copolymer has a weight average molecular weight in the range of from 1000 to 100000 g/mol, at least one wax (b2), at least one corrosion inhibitor (b3) and oxalate and/or phosphate anions (b4), a pretreated metallic substrate obtainable by the aforementioned inventive method, a method of cold forming of a metallic substrate including a step of subjecting the inventive pretreated metallic substrate to a cold forming process, an aqueous lubricant composition (B) as defined above and a master batch for preparing the aqueous composition (B).

BACKGROUND OF THE INVENTION

Cold forming of metallic workpieces is conventionally achieved by rolling such as thread rolling, drawing, in particular sliding drawing or deep-drawing, pressing, stretch forming and/or cold upsetting of the workpieces in order to transform them into articles having a desired shape. Cold forming usually takes place at temperatures below the recrystallization temperature of the metallic material of the workpiece subjected to cold forming, such as at temperatures below and up to 450° C. No external heating source is used in the method of cold forming. Instead, any heat development or temperature increase in general is caused solely by frictional forces between the metallic workpiece and the work tools used during forming and due to internal friction forces generated by material flow in the workpiece. Cold forming usually results in an increased pressure, e.g. for steel, for example in the range of from 200 MPa to 1 GPa and sometimes even up to 2 GPa.

The temperature of the workpieces to be cold formed is initially at ambient temperature, i.e. at approximately 10 to 32° C. In case the workpieces are pre-heated prior to forming, for example to a temperature in the range from 650 to 1250° C., the forming process is no longer a "cold forming" process, but rather a "semi-hot" forming, a hot forming or a forging process.

If the metallic workpieces are cold formed to shaped articles with a comparably only low degree of deformation rather low forces for the cold forming process to take place are needed. For this purpose, conventionally non-reactive forming oils are applied to the workpieces. At higher degrees of deformation, however, usually at least one coating film such as a conversion coating film is applied onto the workpieces prior to the cold forming process, which functions as separating layer between the workpiece and the tools used in order to prevent a cold welding during the cold forming. The conversion coating film used as separating layer in this case can also function as lubricant film if no additional coating film is applied on top of it. Such processes are, e.g., disclosed in DE 1 179 437, DE 1 196 467 and EP 0 233 503 A1:

DE 1 179 437 relates to a pretreatment of wires of iron or steel for a subsequent cold forming. An oxalate coating is applied for this purpose onto the wires. The coating is obtained by making use of a solution containing inter alia oxalic acid and an alkenyl phosphonic acid such as vinyl phosphonic acid in monomeric form.

DE 1 196 467 also relates to a pretreatment of metal substrates for a subsequent cold forming. An oxalate coating is applied for this purpose onto the wires. The coating is obtained by making use of a solution containing inter alia oxalic acid and polyvinyl phosphonic acid and/or a copolymer comprising vinyl phosphonic acid in the form of monomeric units.

EP 0 233 503 A1 relates to a pretreatment method for facilitating a subsequent cold forming of stainless steel substrates. An oxalate coating is applied for this purpose to the substrate. The coating is obtained by making use of an aqueous solution containing inter alia oxalic acid as well as a water-soluble polymer.

Alternatively, it is also possible and known in the prior art that not only the conversion coating film applied onto the metallic substrates can be solely used at the same time as lubricant film, but that rather an additional lubricant composition is further applied onto the conversion coating film to form a lubricant film on top of this film in order to (further) reduce the frictional resistance between the surface of the workpiece and the tools and to avoid the occurrence of cold welding. Different kinds of conversion coating films can be used for this purpose, in particular phosphate or oxalate coating films, which are applied from corresponding phosphate or oxalate containing aqueous acidic compositions. In addition, different kinds of lubricant compositions are known in the prior art. For example, aqueous lubricant compositions such as soaps or soap solutions, e.g. based on alkali or earth alkali stearate, polymer dispersions, solid lubricants such as $MoS_2$ and/or graphite, and/or oil-based lubricants can be used for forming corresponding lubricant films. Processes of this kind are, e.g., disclosed in EP 0 232 929 A1, WO 94/16119 A1, WO 2009/095373 A1, WO 2009/095375 A1, WO 2009/095374 A1 and JP S56 72090 A:

EP 0 232 929 A1 relates to a two-step pretreatment method for facilitating a subsequent cold forming of stainless steel substrates. In a first step an oxalate coating is applied onto the substrate by making use of a solution containing inter alia oxalic acid as well as a water-soluble polymer. Afterwards, in a second step a lubricant is applied onto the oxalate coating. Metal soaps are named as suitable lubricants in EP 0 232 929 A1.

WO 94/16119 A1 discloses a liquid aqueous composition for forming a conversion coating on metal surfaces in a first step for a subsequent cold forming process. The composition comprises an organic cationic polymer and may further comprise oxalate anions. In a second step a lubricating film can be applied onto the conversion film by making use of inter alia oil-based lubricants and/or soaps.

WO 2009/095373 A1 discloses a two-step pretreatment method for facilitating a subsequent cold forming of metal substrates. In a first step a phosphate layer on the surface of the workpiece is formed by using an aqueous acidic phosphatizing solution containing Ca, Mg and/or K cations. In a second step, an aqueous alkaline lubricant composition containing organic polymers is applied.

WO 2009/095375 A1 and WO 2009/095374 A1 both disclose a method for the preparation of metallic workpieces for cold forming. A lubricant coating layer is applied onto the metallic surface of the workpieces optionally bearing a conversion coating layer as separating layer by contacting the surface with an aqueous lubricant composition comprising at least one water-soluble, water-containing or water-binding oxide and/or silicate and an organic polymer in case of WO 2009/095375 A1 or by contacting the surface with an aqueous lubricant composition comprising at least two waxes and an organic polymer in case of WO 2009/095374 A1.

JP S56 72090 A relates to a two-step pretreatment method for facilitating a subsequent cold forming of steel substrates. An oxalate coating is applied for this purpose onto the substrates in a first step. The oxalate coating is obtained by making use of a solution containing inter alia oxalic acid and a water-soluble organic titanium compound as well as a polyvinyl pyrrolidone. In a second step, a lubricant is applied onto the oxalate coating. Metal soaps and solid lubricants are named as suitable lubricants in JP S56 72090 A.

There are, however, several drawbacks as far as the processes known in the prior art are concerned. First of all, both for ecologic reasons and in order to avoid the formation of undesired phosphorous-induced delta ferrite on the substrate, it is desired to not use phosphate coating films as conversion coating films such as the conversion coating films applied in the process disclosed in WO 2009/095373 A1, but to rather only use phosphate-free systems. As far as the lubricant compositions known from the prior art are concerned, oil-based lubricant compositions in general lead to a higher VOC-content, since considerable amounts of oil can evaporate during their use. In addition, oil-based lubricant systems may cause safety issues, as they are flammable and must be stored at flash points >150° C. as hazardous materials. For these reasons, the use of oil-based lubricant formulations is undesired. Solid lubricants such as lubricants based on $MoS_2$ and/or graphite are only feasible for heavy cold forming with extensive degrees of deformation and thus, such lubricants are of limited use only. Furthermore, sulfide present in such lubricant films often has a detrimental effect in particular on stainless steel. The use of aqueous lubricant compositions is thus more desirable both for ecologic and economic reasons than using solid and/or oil-based lubricants.

The conventional aqueous lubricant compositions of the prior art are, however, usually alkaline compositions such as the (metal) soaps and soap solutions disclosed in EP 0 232 929 A1, WO 2009/095373 A1, WO 2009/095375 A1, WO 2009/095374 A1 and JP S56 72090 A, which are for example based on alkali or earth alkali stearate. Such alkaline lubricant composition baths often have only comparably short lifetimes and thus have to be renewed rather frequently. This, of course, is disadvantageous both from an ecological view (higher amounts of water and of the constituents present in the compositions have to be used) and an economic view (higher energy costs and changeover time). In contrast to these aqueous alkaline lubricant compositions used for providing a lubricant layer on the prior to be applied conversion coating layer, the compositions used for generating said aforementioned conversion coating layer are acidic compositions as already mentioned hereinbefore. For performing such a two-steps pretreatment process usually two different open treatment baths are employed, into which the metallic workpieces are dipped, namely a first bath containing the aqueous acidic conversion coating composition and a second bath containing the aqueous alkaline lubricant composition. It is essential, however, to include a rinsing and/or neutralization step between these two dipping steps in order to remove any excessive acid present onto the workpiece after having it removed from the first acidic bath and before having dipped it into the second alkaline bath in order to preserve the life of the two baths and in particular of the second bath as long as possible. It is, however, disadvantageous for economic and ecological reasons to have to necessarily carry out such a rinsing and/or neutralization step. Simple mixing or combining the conventional aqueous acidic compositions such as phosphate and/or oxalate compositions for providing the conversion coating layer with the conventional aqueous alkaline compositions for providing the lubricant layer is not possible as these compositions are not miscible with each other and consequently an undesired phase separation would be observed. Moreover, most of the known organic polymer dispersions used for preparing conventional aqueous alkaline lubricant compositions are unstable in an acidic environment. Therefore, it is not always possible to simply use acidic versions of the known aqueous alkaline lubricant compositions.

EP 3 290 544 A1 relates to an acidic water-based lubricating coating agent having a pH value of 2.0 to 6.5, which inter alia contains a chemical conversion component such as oxalic acid and a lubricating component such as a lipophilic lubricating component including an oil or a soap. The coating agent may further comprise a water-based resin as a binder component. EP 3 290 544 A1 further discloses a one-step pretreatment method of metal substrates for a subsequent cold forming.

JP S54 5847 A relates to a lubricant composition for facilitating the cold forming of metals. The lubricant contains oxalic acid and at least one constituent selected from water-soluble organic titanium compounds, vinyl pyrrolidone homopolymers and vinyl pyrrolidone copolymers. The lubricant composition may further contain a lubricating aid.

In addition, the conventional pretreatment processes for cold forming known in the prior art not always result in a sufficiently high coating weight of the lubricant layer formed on the workpiece or—if a separating layer such as a conversion coating layer is also present underneath the lubricant layer—in a sufficiently high coating weight of the lubricant layer and said separating layer combined. This may result in only insufficient adhesion properties of the layer(s) to the metallic substrate. Further, this can result in an ineffective separation of the tool from the workpiece after and during cold forming and in an only ineffective reduction of the coefficient of friction or even in an undesired cold welding, as an only insufficiently high amount of the coating layer(s) as measured by their coating weight remains present on the workpieces during the cold forming process.

Thus, there is a need for simplifying the conventional surface pretreatment processes for metal cold forming that make use of aqueous lubricant compositions both for economic reasons and for ecological reasons, in particular to provide an improved technology for the water-based pretreatment of metallic substrates for the cold forming process that requires fewer treatment steps and makes use of aqueous acidic lubricant compositions. At the same time such a simplified pretreatment must still lead to sufficiently high coating weights of the coating layer(s) formed on the metallic substrates in order to both ensure a good adhesion to the substrate and an effective reduction of the coefficient of friction during cold forming and to prevent cold welding.

Problem

It has been therefore an object underlying the present invention to provide a simplified surface pretreatment method for metal cold forming that make use of an aqueous lubricant composition both for economic reasons and for ecological reasons, in particular to provide an improved technology for the water-based pretreatment of metallic substrates for the cold forming process that requires fewer treatment steps and makes use of aqueous acidic lubricant compositions. At the same time, however, such a simplified pretreatment must still lead to sufficiently high coating weights of the coating layer(s) formed on the metallic substrates in order to both ensure a good adhesion to the substrate and an effective reduction of the coefficient of friction during cold forming and to prevent any cold welding.

Solution

This object has been solved by the subject-matter of the claims of the present application as well as by the preferred embodiments thereof disclosed in this specification, i.e. by the subject matter described herein.

A first subject-matter of the present invention is a method for pretreatment of a metallic substrate for a subsequent metal cold forming process, said method comprising at least steps (1) and (2) and optionally step (3), namely (1) providing at least one substrate having at least one surface at least partially made of at least one metal, (2) contacting the at least one surface of the substrate provided in step (1), optionally after having been contacted according to step (2), with an aqueous lubricant composition (B) having a pH value in the range of from 0.1 to 6.0, wherein the aqueous lubricant composition (B) comprises besides water, which is present in composition (B) in an amount of at least 40 wt.-%, based on the total weight of composition (B), (b1) at least one film-forming polymer, which is a homopolymer and/or copolymer being prepared by polymerization of at least vinyl pyrrolidone as at least one monomer, wherein said homopolymer and/or copolymer has a weight average molecular weight in the range of from 1000 to 100000 g/mol, (b2) at least one wax, which is different from constituent (b1), (b3) at least one corrosion inhibitor, which is different from both constituents (b1) and (b2) and (b4) oxalate and/or phosphate anions, preferably oxalate or phosphate anions, and (3) optionally drying the coating film obtained after having performed step (2).

A further subject-matter of the present invention is a pretreated metallic substrate obtainable by the inventive method.

A further subject-matter of the present invention is a method of cold forming a metallic substrate, characterized in that it comprises a step of subjecting the inventive pretreated metallic substrate to a cold forming process.

A further subject-matter of the present invention is an aqueous lubricant composition (B) as defined hereinbefore in connection with the inventive pretreatment method.

A further subject-matter of the present invention is a master batch to produce the inventive aqueous composition (B) by diluting the master batch with water and if applicable by adjusting the pH value.

It has been surprisingly found that aqueous lubricant composition (B) is compatible to organic and/or inorganic acids, in particular to oxalic acid and phosphoric acid, and that it is thus possible to include such an acid, in particular oxalate and/or phosphate, into composition (B). This has the advantage that composition (B) can be used in the inventive method both as lubricant composition and as a conversion coating composition in a single step only and that, consequently, it is not necessary to apply any conversion coating in an additional step prior to applying the lubricant, which, of course, has both economic and ecologic advantages. In particular, it has been surprisingly found that all constituents present in aqueous lubricant composition (B) can be formulated as and into an acidic composition at a pH value in the range of from 0.1 to 6.0. It has been in particular surprisingly found that composition (B) is stable under such acidic conditions and that in particular the at least one film-forming polymer (b1) as well as the at least one wax (b2) present in composition (B) are stable in such an acidic environment in the additional presence of oxalate and/or phosphate anions (b4), even when these anions are present in comparably high concentrations in composition (B).

It has been further surprisingly found that as composition (B) can be used in the inventive method both as lubricant composition and as a conversion coating composition in a single step only no rinsing and/or neutralization steps have to be performed at all in contrast to conventional multi-step methods, wherein such a rinsing and/or neutralization step has to be performed at least after applying the conversion coating composition and before applying the lubricant composition. In addition, it has been further found that the coating film obtained after step (2) is a combined conversion and lubricant film. Thus, the coating film obtained combines the properties of a conversion layer and a lubricant layer. The lubricant coating film can be present on top of the conversion coating film. The combined layers can be separated and adjusted in part.

In addition, it has been surprisingly found that the coating layer obtained from applying composition (B) adheres firmly on the substrate and shows good lubricant properties. Thus, the substrate pretreated by the inventive method can be subsequently subjected to a metal cold forming process including cold extrusion and wire drawing with high speed drawing. In the cold forming of substrates it has been found that a coating layer obtained from application of composition (B) to the substrate can be efficiently subjected to a drawing step for the purpose of metal cold forming. In the cold forming of substrates such as steel wire in a wire-drawing machine, it has been found that a lubricant layer obtained from application of composition (B) to the substrate can be efficiently used even with a drawing up to 35% cross-area, decreasing in each drawing step.

Furthermore, it has been surprisingly found that the coated metallic substrates obtained by the inventive method bear a sufficiently high coating weight of the coating layer(s) formed on the metallic substrates obtained from applying composition (B). The resulting coating layer(s) is/are homogenous, thick and adhered firmly on the surface of the substrate. It has been found that such a high coating weight not only ensures a good adhesion to the substrate, but also an effective reduction of the coefficient of friction during cold forming and to prevent any cold welding. It has been surprisingly found that higher coating weights are obtained when performing the inventive method comprising one contacting step (step (2)) only compared to performing conventional multi-step methods, wherein conversion coating and lubricant layers are applied in separate steps.

Moreover, it has been found that coated metal workpieces obtained from the inventive method have a good corrosion resistance. It has been surprisingly found in this regard that the presence of the corrosion inhibitor (b3) in composition (B) does not negatively influence the formation of an oxalate and/or phosphate conversion coating layer in any manner when performing the inventive method as the conversion coating layer formed has an excellent coating quality, in particular when an alkindiol such as butindiol is used as constituent (b3). Further, it has been found that no stable foams have been formed during the inventive surface treatment process.

In addition, it has been surprisingly found that the lubricant properties of the lubricant film obtained after step (2) or after optional step (3) of the inventive method are in particular improved compared to making use of conventional lubricant compositions due to the use of the specific film-forming polymer (b1) in combination with the at least one wax (b2). It has been found that, e.g. homopolymers and/or copolymers, which are prepared by polymerization of at least vinyl pyrrolidone as at least one monomer and which are used in combination with at least one wax (b2) provide better lubricating films for use in the field of cold forming than lubricant films prepared by making use of combinations of waxes and corresponding polymers that are prepared by making use of vinyl alcohol or (meth)acrylic acid.

It has been further surprisingly found that baths containing the acidic aqueous lubricant composition (B) have comparably long lifetimes, in particular longer lifetimes that bath containing conventional alkaline aqueous lubricant compositions. This, of course, has economic and ecologic advantages.

DETAILED DESCRIPTION OF THE INVENTION

The term "comprising" in the sense of the present invention, in particular in connection with the inventive method, the inventive composition (B) and the master batch used to prepare the composition (B), preferably has the meaning "consisting of". In this case, for example, with regard to the inventive composition (B), in addition to the mandatory constituents therein (constituents (b1) to (b4) and water) one or more of the further optional components mentioned hereinafter may be contained in the composition. The same principle applies with respect to the composition (B) used in the inventive method and the master batch. All components/constituents can be present in each case in their preferred embodiments mentioned hereinafter. The same applies to the further subject-matters of the present invention.

Inventive Pretreatment Method

The inventive method is a method for pretreatment of a metallic substrate for a subsequent metal cold forming process. The inventive method comprises at least steps (1) and (2) and optionally additionally step (3). The inventive method may comprise one or more further additional optional steps.

Step (1)

In step (1) of the inventive method at least one substrate having at least one surface at least partially made of at least one metal is provided.

The surface of the substrate used is at least partially made of at least one metal, i.e. at least one region of said surface is made of at least one metal. The surface can consist of different regions comprising different metals. Preferably, the overall surface of the substrate is made of at least one metal. More preferably, the substrate consists of at least one metal.

Preferably, the at least one metal is selected from the group consisting of aluminum, aluminum alloys, zinc, steel including cold rolled steel, hot rolled steel, galvanized steel (zinc plated steel) including hot-dip galvanized steel (hot zinc dipped steel) or electrolytically galvanized steel, steel alloys, magnesium and/or zinc-magnesium alloys and/or zinc-iron alloys and mixtures thereof. In particular, the metal is ferrous and most preferably is steel and/or steel alloy.

Preferably, the at least one surface of the substrate is at least partially made of steel and/or of a steel alloy, more preferably the substrate as such is made of steel and/or of a steel alloy.

As substrates e.g. strips, sheets, slugs, wires, wire coils, more complicated shaped parts, sleeves, profiles such as hollow or solid profiles, tubes, discs, discs, rods, bars or cylinders can be used.

Optional Steps (1a) and (1b) and (1c)

The surfaces to be substrates provided in step (1) may be cleaned by means of an acidic, alkaline or pH-neutral cleaning composition and/or etched before treatment with the composition (B) in step (2) as it will be outlined hereinafter: Prior to step (2) of the inventive method one or more of the following optional steps can be performed, preferably in this order:

- Step (1a): cleaning, preferably by making use of an alkaline aqueous cleaning composition, and optionally subsequently rinsing the surface of the substrate provided in step (1), and/or
- Step (1b): subjecting the surface of the substrate to acidic pickling, i.e., etching, and subsequently rinsing the surface of the substrate, and/or
- Step (1c): optionally activating the surface of the substrate by using an aqueous activating composition (A) being different from composition (B).

Alternatively, optional steps (1a) and (1b) may be performed in one step. Preferably, both steps (1a) and (1b) are performed. Rinsing included in step (1a) is preferably performed with deionized water or tap water. Preferably, the acidic pickling is performed by making use of hydrochloric acid, hydrofluoric acid, sulphuric acid, nitric acid and/or phosphoric acid. In the case phosphate anions are present as constituent (b4) in composition (B), the surface of the substrate can optionally be activated by using an aqueous activating composition (A) according to optional step (1c), e.g. by using commercially available activating product Gardolene® V 6522 from Chemetall GmbH.

Step (2)

In step (2) of the inventive method the at least one surface of the substrate provided in step (1) is contacted with, preferably dipped into, an aqueous lubricant composition (B).

The treatment procedure according to step (2), i.e. the "contacting", can, for example, include a spray coating and/or a dip coating procedure. The composition (B) can also be applied by flooding the surface or by roll coating or even manually by wiping or brushing. However, dipping is preferred. In this case, the substrate used is dipped into a bath containing the composition (B).

Preferably, contacting step (2) is performed by at least partially dipping the substrate into a bath containing the aqueous lubricant composition (B) having a bath temperature in the range of from 20 to 95° C., preferably of from 45 to 92.5° C., in particular of from 50 to 90° C., most preferably of from 60 to 90° C.

The treatment time, i.e. the period of time the surface is contacted with the aqueous composition (B) used in step (2) is preferably from 15 seconds to 20 minutes, more preferably from 30 seconds to 10 minutes, and most preferably 45 seconds to 8 minutes, as for example 1 to 4 minutes.

Preferably, no rinsing step is performed after having carried out step (2).

Composition (B)

The term "aqueous" with respect to composition (B) in the sense of the present invention preferably means that the composition (B) is a composition containing at least 50 wt.-%, preferably at least 60 wt.-%, more preferably at least 70 wt.-% in particular at least 80 wt.-%, most preferably at least 90 wt.-% or 95 wt.-% or 98 wt.-% or 99 wt.-% or even 100 wt.-% of water, based on its total content of organic and inorganic solvents including water. Thus, the composition (B) may contain at least one organic solvent besides water—however, in an amount significantly lower than the amount of water present. Preferably, composition (B) is free of organic solvents. Thus, preferably water is the only solvent/diluent present.

Composition (B) contains water in an amount of at least 40 wt.-%. Preferably, composition (B) contains water in an amount of at least 45 wt.-% or at least 50 wt.-%, more preferably of at least 60 wt.-%, even more preferably of at least 70 wt.-% and still more preferably of at least 80 wt.-%, in each case based on the total weight of composition (B).

Preferably, composition (B) has a pH value in the range of from 0.1 to 6.0, more preferably in the range of from 0.2 to 5.8, even more preferably in the range of from 0.3 to 5.6, still more preferably in the range of from 0.5 to 5.5, yet more preferably in the range of from 0.6 to <5.0.

Preferably, if the aqueous lubricant composition (B) comprises (b4) oxalate anions and not any phosphate anions or phosphate anions in an amount in g/l lower than the amount of the oxalate anions in g/l it has a pH value below 2.0. More preferably, composition (B) in this case has a pH value below 1.9, preferably below 1.7, in particular a pH value in a range of from 0.1 to 1.5, most preferably in a range of from 0.5 to 1.5.

Preferably, if the aqueous lubricant composition (B) comprises (b4) phosphate anions and not any oxalate anions or oxalate anions in an amount in g/l lower than the amount of the phosphate anions in g/l it has a pH ≥2.0, more preferably >2.2.

Preferably, composition (B) is present in the form of a solution or dispersion, in particular in the form of a solution, preferably at a temperature of at least 40° C., in particular at least 50° C.

Preferably, composition (B) has a solid content in the range of from 0.1 to 30 wt.-%, more preferably in the range of from 0.2 to 25 wt.-%, even more preferably in the range of from 0.3 to 20 wt.-%, still more preferably in the range of from 0.4 to 15 wt.-%, in each case based on the total weight of composition (B).

The sum of all components/constituents present in composition (B) adds up to 100 wt.-%.

Since composition (B) comprises at least one of oxalate and/or phosphate anions as constituent (b4), it represents an oxalating composition and/or phosphating composition, which is suitable of forming a conversion coating on the surface of a substrate. Since composition (B) further comprises (b2) at least one wax and at least one film-forming polymer (b1) it anyhow also represents a lubricant composition at the same time, which is suitable of forming a lubricating coating on the surface of a substrate.

Constituent (b1)

Composition (B) comprises at least one film-forming polymer, which is a homopolymer and/or copolymer being prepared by polymerization of at least vinyl pyrrolidone as at least one monomer, wherein said homopolymer and/or copolymer has a weight average molecular weight in the range of from 1000 to 100000 g/mol as constituent (b1), which is different from constituent (b2).

Preferably, the at least one film-forming polymer is water-soluble or water-dispersible, more preferably water-soluble. Preferably, the at least one film-forming polymer is soluble or dispersible, more preferably soluble, in composition (B).

In case the at least one film-forming polymer (b1) is a copolymer at least one further monomer bearing at least one ethylenically unsaturated group, preferably at least one vinyl group, and being different from vinyl pyrrolidone can be used for preparing constituent (b1). Preferably, at least one further vinyl monomer different from vinyl pyrrolidone is used. However, such further monomers may also or alternatively bear at least one (meth)acrylic group. (Meth)acrylic groups include e.g. (meth)acrylate groups and (meth)acrylic acid groups. Preferably, however, no monomers with acid groups are used. The further monomer can be an ionomer. The further monomer can also be ethylene, propylene, butylene, styrene etc. The term "(meth)acryl" means "acryl" and/or "methacryl". Similarly, "(meth)acrylate" means acrylate and/or methacrylate.

Preferably, the at least one film-forming polymer (b1) is a homopolymer being prepared from vinyl pyrrolidone or a copolymer being prepared from vinyl pyrrolidone and at least from at least one monomer selected from the group consisting of vinyl amine, vinyl alcohol, vinyl formamide, vinyl caprolactam, vinyl acetate and vinyl imidazole. Preferably, the amount of structural units derived from the at least one further monomer different from vinyl pyrrolidone in the copolymer is 50 mol-% at most. Preferably, the amount of structural units derived from vinyl pyrrolidone in the copolymer is 50 mol-% at least and more preferably is at least 60 mol-% or at least 70 mol-% or at least 75 mol-%.

Most preferred are polyvinyl pyrrolidone homopolymers and copolymers of vinyl pyrrolidone and vinyl acetate. An exemplary polymer is Sokalan® K 17P, from BASF SE, Germany.

Preferably, the at least one film-forming polymer (b1) has a weight average molecular weight in the range of from 1500 to 100000 g/mol, more preferably of from 3000 to 75000 g/mol or from 5000 to 100000 g/mol or from 5000 to 75000 g/mol, still more preferably of from 5000 to 50000 g/mol. Determination of M. (weight average molecular weight) is performed by gel permeation chromatography (GPC). In particular M, of (b1) is below 50000 g/mol.

Preferably, the at least one film-forming polymer (b1) is present in the composition (B) in an amount in the range of from 0.05 to 20 wt.-%, more preferably in the range of from 0.10 to 15 wt.-%, even more preferably in the range of from 0.15 to 10 wt.-%, still more preferably in the range of from 0.20 to 7.5 wt.-%, in particular of from 0.25 to 5.0 wt.-%, in each case based on the total weight of the composition (B).

Constituent (b2)

Composition (B) comprises at least one wax as constituent (b2), which is different from constituent (b1).

As the term "wax" already implies, the at least one wax is a solid substance at room temperature (23° C.). A person skilled in the art is familiar with the term "wax". Said term is e.g. defined in by the German Society for Fat Science (DGF) within DGF standard method M-I 1 (75) (2015). Preferably, the at least one wax used as constituent (b2) satisfies this definition of a wax. Waxes according to this definition can be kneaded at 20° C., have a firm (solid) to brittle hardness, have a coarse to fine crystalline structure, are translucent to opaque in color but not glassy or glass-like, melt without decomposition at temperatures above 40° C., are slightly liquid above their melting point and have a low viscosity above their melting point, have a highly temperature-dependent consistency and solubility, and can be polished under light pressure. Preferably and according to the definition of the DGF (DGF standard method M-I 1 (75)), a substance is not a wax if it does not meet more than one of the above properties.

Preferably, the at least one wax (b2) is water-soluble or water-dispersible, more preferably water-dispersible. Preferably, the at least one wax (b2) is soluble or dispersible in composition (B).

Preferably, composition (B) is obtainable by using an aqueous dispersion or solution of the at least one wax (b2) for its preparation.

Preferably, the at least one wax (b2) has a melting point in the range of from 30° C. to 170° C., more preferably in the range of from 40° C. to 165° C., especially preferred in the range of from 60° C. to 160° C.

Composition (B) preferably comprises more than one wax as constituent (b2). Preferably, composition (B) comprises at least two, more preferably at least three different waxes as constituents (b2). Preferably, the at least two or at least three different waxes differ from each other at least in their melting temperature (melting point). Preferably, the difference between melting points of at least two of the waxes is at least 20° C.

Preferably, the at least one wax (b2) is present in the composition (B) in an amount in the range of from 0.1 to 20 wt.-%, more preferably in the range of from 0.5 to 15 wt.-%, even more preferably in the range of from 0.75 to 12.5 wt.-%, still more preferably in the range of from 1.0 to 10.0 wt.-%, in particular of from 1.5 to 9.0 wt.-%, most preferably in the range of from 2.0 to 7.5 wt.-%, in each case based on the total weight of the composition (B).

Preferably, the at least one wax (b2) is selected from the group consisting of cationic waxes, cationically stabilized waxes and non-ionic waxes. A "cationically stabilized wax" is preferably a wax that is stabilized by cationic groups in acidic medium such as in the composition (B) or is stabilized by at least one cationic surfactant.

Preferably, the at least one wax (b2) is stabilized by at least one emulsifier. For example, the at least one wax (b2) can be stabilized by a cationic emulsifier (cationically stabilized) or can be stabilized by a non-ionic emulsifier (non-ionically stabilized). Examples of cationic emulsifiers are alkoxylated such as ethoxylated stearyl amine and/or polyalkoxylated such as polyethoxylated tallow amine. Examples of non-ionic emulsifiers are alcohols including for example diethylaminoethanol.

Preferably, the at least one wax (b2) is selected from the group consisting of polyolefin waxes (including polyethylene waxes, in particular HDPE (high density polyethylene) and/or polypropylene waxes, natural waxes including plant and animal waxes such as montan waxes, bees waxes and/or carnauba waxes, paraffin waxes (petroleum derived waxes) and mixtures thereof.

In this context, the term "olefin" mainly refers to alkenes typical of polyolefins, preferably alkenes with 2 to 8, especially alkenes with 2 to 6 and especially alkenes with 2 to 4 carbon atoms, especially those with a terminal double bond. In the context of this invention, preferred representatives are ethylene, propylene, 1-butene and isobutene. Ethylene and propylene are particularly preferred olefin monomers in the context of this invention. The term "polyolefin" is generally understood to mean homopolymers of a single type of olefin monomer (e.g. ethylene homopolymers) or copolymers of at least two olefin monomers (e.g. polymers of mixtures comprising or consisting of ethylene, propylene, 1-butene and/or isobutene). Polyolefins thus contain one or more types of olefin monomers and are therefore homopolymers or copolymers. However, they may also additionally contain one or more ethylenically unsaturated monomers other than olefin monomers, in particular ethylenically unsaturated monomers bearing carboxylic acid groups, polymerized or grafted. If different ethylenically unsaturated monomers with carboxyl groups or carboxylic acid anhydride groups are used for the purpose of polymerization or grafting of the olefin monomers, this is done in an amount such that the polyolefin wax as constituent (a5) containing carboxyl groups has an acid number in the range from 3 to 50, preferably from 5 to 40, particularly preferably from 8 to 35, very particularly preferably from 10 to 25 and particularly preferably from 13 to 20 mg KOH/g. Polyolefin waxes are preferably selected from the group consisting of oxidized polyethylene waxes, oxidized polypropylene waxes, oxidized poly(ethylene-co-propylene) waxes and oxidized ethylene-olefin copolymers, ethylene-(meth)acrylic acid copolymers and polymers of ethylene and/or propylene other than the abovementioned copolymers, which have been grafted, for example, with maleic anhydride (converted into the hydrolyzed form, and carrying free COOH groups). Of course, other ethylenically unsaturated acids such as acrylic acid can also be used for grafting.

The paraffin waxes used are preferably microcrystalline.

Exemplary waxes that are commercially available and that can be used are, e.g. Aquacer® 1041 from BYK Chemie, Germany, Aquacer® 561 from BYK Chemie, Aquacer® 517 from BYK Chemie, Wukonil® O-33a from Münzing Chemie and Licowax® KST from Clariant, Germany, Constituent (b3)

Composition (B) further comprises at least one corrosion inhibitor, which is different from both constituents (b1) and (b2).

The term "corrosion inhibitor" is a term known to a person skilled in the art. Said term is for instance defined in Römpp Lexikon, Lacke und Druckfarben 1998, Georg Thieme Verag, 10. Auflage".

Examples of corrosion inhibitors for use as constituent (b3) are morpholine, benzylamine, butindiol, diisopropylamine nitrite, morpholine nitrite, 2-(2-heptadec-8-enyl-2-imidazolin-1-yl)ethanol, dicyclohexylamine nitrite, cyclohexylamine benzoate, dicyclohexylamine caprylate, guanadine chromate, hexamethyleneimine benzoate, dicyclohexylamine benzoate, ethylaniline, mercaptobenzotriazole, pyridine, rosin amine, phenylacridine, hexamethylentetramin, nonylphenoxyacetic acid, succinic acid semi-ester and alkindiols such as butindiol. Alkindiols and in particular butindiol are most preferred. Preferably, the at least one corrosion inhibitor is present in composition (B) is preferably in an amount of from 0.01 to 5.0 wt.-%, more preferably of from 0.05 to 4.0 wt.-%, even more preferably of from 0.1 to 3 wt.-%, in particular of from 0.1 to 1.5 wt.-%, in each case based on the total weight of composition (B).

Constituent (b4)

Composition (B) further comprises oxalate and/or phosphate anions as constituent(s) (b4), preferably comprise oxalate or phosphate anions as constituent(s) (b4).

Preferably, oxalate anions (b4) are present in the composition (B) in an amount in the range of from 2 to 500 g/l, more preferably of from 5 to 100 g/l, in particular of from 10 to 50 g/l of oxalic acid, calculated in each case as oxalic acid dihydrate. In this case, preferably no additional phosphate anions are present.

In the sense of the present invention, "oxalic acid" also means the single and double deprotonated form of oxalic acid. Likewise, in the sense of the present invention, "oxalate" also means the single and double protonated form thereof, the double protonated from being oxalic acid. Preferably, oxalic acid dihydrate is used, as is it cheap and less hygroscopic.

Preferably, phosphate anions (b4) are present in the composition (B) in an amount in the range of from 2 to 500 g/l, particularly preferably in the range from 4 to 320 g/l, most particularly preferably in the range from 8 to 200 g/l, in particular in the range from 12 to 120 g/l, calculated in each case as $PO_4$. In this case, preferably no additional oxalate anions are present.

If, in connection with weight concentrations (e.g., g/i), the term "calculated as X" is used, where X is a specific, specified chemical compound, this is to be understood as follows: If an alternative chemical compound (not X) it should be used in such a molar concentration as calculated for X, taking into account its molar mass, from the specific weight concentration (e.g. g/l) indicated in each case.

Optional Constituents (b5)

Composition (B) may further comprise at least one of optional constituent (b5).

Optionally, at least one accelerator comprising nitro guanidine and/or at least one source of iron(III) cations, is present in composition (B) as at least one constituent (b5), in particular when (B) comprises oxalate anions as constituent (b4). A source of iron(III) cations in the sense of the present invention is preferably a water soluble iron(III) salt such as iron(III) nitrate. Also, a water soluble iron(II) salt in combination with an oxidizing agent suitable for the production of iron(III) cations can be used as a source of iron(III) cations.

Nitro guanidine is preferably present in the composition (B) in in an amount in the range of from 0.01 to 20 g/l, more preferably of from 0.5 to 10 g/l and in particular of from 1.0 to 5 g/l, while the content of iron(III) is preferably in the range of from 0.0004 to 2 g/l, more preferably of from 0.04 to 2 g/l and especially preferred from 0.4 to 2 g/l, calculated as iron(III) nitrate.

Optionally, at least one nitrate as accelerator is present in composition (B) as at least one constituent (b5), in particular when (B) comprises phosphate anions as constituent (b4). Preferably, nitrate is present in an amount in the range from 1 to 600 g/l, particularly as nitrate anions, particularly preferably in the range from 4 to 450 g/l, most particularly preferably in the range from 8 to 300 g/l, in particular in the range from 16 to 200 g/l.

In particular when (B) comprises phosphate anions as constituent (b4), additional or alternative accelerators are selected from the group consisting of chlorate, guanidine, hydroxylamine, nitrite, nitrobenzene, sulfonate, perborate, peroxide, peroxysulfuric acid and other accelerators containing nitro groups. A low or moderate content of nitrate can have an accelerating effect on electrolytic phosphating and can therefore be advantageous.

In particular when (B) comprises phosphate anions as constituent (b4), composition (B) may further comprise at least one constituent selected from the group consisting of organic acids and phosphonic acids and the salts and esters thereof in the range from 0.1 to 200 g/l, particularly preferably in the range from 1 to 150 g/l, most particularly preferably in the range from 3 to 100 g/l, in particular in the range from 6 to 70 g/l. These constituents may act in particular as complexing agents.

In particular when (B) comprises phosphate anions as constituent (b4), composition (B) may further comprise at least one cation selected from the group consisting of Zn, Mg, Ca, Ni, Cu and/or Mn, preferably in the range from 4 to 100 g/L, particularly preferable in the range from 5 to 60 g/L, most particularly preferably in the range from 8 to 50 g/L.

The content of cations and anions mentioned herein with respect to composition (B) can be monitored and determined by the means of ICP-OES (optical emission spectroscopy with inductively coupled plasma). Said method is described hereinafter in detail. The content of free fluoride anions is, however, determined by means of a fluoride electrode.

Further Optional Constituents

Optionally, composition (B) may comprise at least one further constituent (b6). Said at least one further constituent (b6) is preferably selected from the group consisting of thickeners, pigments, fillers, defoamers, surfactants and mixtures thereof. Constituent(s) (b6) may be present in amount of from 0.01 to 10 wt.-% in composition (B), based on the total weight of composition (B).

Examples of defoamers are polymer-based, silicone-free defoamers. If a defoamer is present, which is preferred, the amount of the at least one defoamer in composition (B) is preferably in a range of from 0.01 to 3 wt.-%, based on the total weight of composition (B).

Examples of thickeners are polysaccharide, polysiloxane, polyvinlyamide, polyacrylamide and polyglycol.

Examples of pigments and fillers are boron nitride, graphite and molybdenum sulfide. However, as in particular graphite and molybdenum sulfide are solid lubricants and their use is related to disadvantages as outlined in the introductory part, preferably no such pigments, in particular neither graphite nor molybdenum sulfide, is present in composition (B).

Examples of surfactants are fatty alcohol alkoxylates and especially fatty alcohol ethoxylates.

Optional Step (3)

Optional step (3) of the inventive method is a step, wherein the coating film obtained after step (2) is optionally dried.

The drying step (3) may be preferably performed, e.g. at a temperature in the range of 15° C. to 100° C., more preferably at a temperature in the range of 18° C. to 95° C., in particular at a temperature in the range of 20° C. to 90° C.

Inventive Pretreated Substrate

A further subject-matter of the present invention is a pretreated metallic substrate obtainable by the inventive method.

All preferred embodiments described above herein in connection with the inventive method of pretreatment are also preferred embodiments of pretreated substrate. The same applies, of course, to the embodiments of the substrate as such as outlined hereinbefore in connection with step (1) of the inventive method.

The coating film obtained after step (2) or optionally after step (3) is a combined conversion and lubricant coating film.

Thus, the coating film obtained combines the properties of a conversion layer and a lubricant layer.

Preferably, the pretreated metallic substrate obtainable by the inventive method contains a conversion coating film obtained by performing step (2) and further contains a lubricant coating film on top of said conversion coating film also obtained by performing step (2). However, it is also possible that the coating film obtained after step (2) or optionally after step (3) is chemically heterogeneous.

Preferably, the coating film present on the surface of the substrate after having performed step (2) and optionally step (3) has a coating weight in a range of from 1.0 to 40.0 g/m$^2$, preferably in a range of from 5.0 to 35.0 g/m$^2$, more preferably in a range of from 10.0 to 30.0 g/m$^2$. The method for determining the coating weight is disclosed in the example section.

Inventive Cold Forming Method

A further subject-matter of the present invention is a method of cold forming a metallic substrate, characterized in that it comprises a step of subjecting the inventive pretreated metallic substrate according to a cold forming process, preferably by drawing.

All possible cold forming processes known in the prior art can be carried out, in particular rolling such as thread rolling or beating, e.g. for nut or bolt blanks, drawing, in particular sliding drawing (tensile compression forming), e.g. of welded or seamless tubes, hollow sections, solid sections, wires or rods, e.g. during wire drawing or tube drawing, or deep-drawing, e.g. of strips or sheet metal, pressing such as cold extrusion (pressure forming), e.g. of hollow or solid bodies, stretch forming (forming to gauge block/final size) and/or cold upsetting, e.g. from wire sections to fasteners such as nuts.

The most common shaped bodies to be formed from the inventive pretreated metallic substrates are strips, sheets, slugs, wires, wire coils, more complicated shaped parts, sleeves, profiles such as hollow or solid profiles, tubes, discs, discs, rods, bars or cylinders.

Preferably, the cold-formed substrate obtained after the cold forming process still bears at least part of the coating film obtained after having performed step (2) and optionally step (3): Due to the amount of the coating weight of the coating film obtained after step (2) or optionally step (3) present on the pretreated substrate, said coating film "survives" conventional cold forming processes. For example, this leaves at least 10%, preferably at least 15%, particularly preferred at least 20% of the coating weight on a pretreated and cold formed substrate after cold forming, in particular if the substrate has undergone a drawing.

However, the coating film may be removed from the cold formed substrate, e.g., by using an aqueous cleaning composition. Thus, after the cold forming process, the obtained substrate is preferably cleaned, in order to remove the conversion and lubricant coating film from the substrate, e.g. by means of alkaline cleaners, acids or pickling agents.

Inventive Composition (B)

A further subject-matter of the present invention is an aqueous lubricant composition (B) as defined hereinbefore in connection with the inventive pretreatment method.

All preferred embodiments described above herein in connection with the inventive method and the composition (B) used in step (2) thereof and the constituents contained therein are also preferred embodiments of the inventive composition (B).

Inventive Master Batch

A further subject-matter of the present invention is a master batch to produce the inventive aqueous composition (B) by diluting the master batch with water and if applicable by adjusting the pH value.

All preferred embodiments described above herein in connection with the inventive methods and the inventive composition (B) and the constituents contained therein are also preferred embodiments of inventive master batch.

If a master batch is used to produce the aqueous composition (B) according to the present invention, the master batch typically contains the constituents of the aqueous composition (B) to be produced in the desired proportions, but at a higher concentration. Such master batch is preferably diluted with water to the concentrations of constituents as disclosed above to form the aqueous composition (B). If necessary, the pH value of the aqueous composition (B) may be adjusted after dilution of the master batch.

Of course, it is also possible to further add any of the optional components to the water, wherein the master batch is diluted or to add any of the optional components after diluting the master batch with water. It is however preferred that the master batch already contains all necessary components.

Preferably, the master batch is diluted with water and/or an aqueous solution in the ratio of 1:5,000 to 1:10, more preferred 1:1,000 to 1:10, most preferred in the ratio of 1:300 to 1:10 and even more preferred 1:150 to 1:50 to produce composition (B).

Methods

1. Total Acid (TA)

The total acid (TA) is the sum of the divalent cations present as well as free and bound oxalic acids and/or phosphoric acid. It is determined by the consumption of 0.1 M NaOH using a pH meter and an electrode. For this, 10 ml of the composition are pipetted into a suitable vessel, for example a 300 ml Erlenmeyer flask and diluted with 25 ml of deionized water. It is then titrated with 0.1 M NaOH to a pH of 9. The consumption in ml per 10 ml of the diluted composition corresponds to the total acid score (TA).

2. Free Acid (FA) and Fischer Total Acid (TAF)

The free acid (FA) is determined by the consumption of 0.1 M NaOH using a pH meter and an electrode. For this, 5 ml of the composition are pipetted into a suitable vessel, for example a 300 ml Erlenmeyer flask and diluted with 50 ml of deionized water. It is then titrated with 0.1 M NaOH to a pH of 4. The consumption in ml per 10 ml of the diluted composition corresponds to the free acid score (FA). After FA titration, 40 mL of 30% potassium oxalate solution is added into the solution. It is then titrated with 0.1 M NaOH to a pH of 9. The consumption in ml per 10 ml of the diluted composition corresponds to the Fischer total acid score (TAF)

3. Solid Content

The non-volatile fraction (solids or solid content) is determined in accordance with DIN EN ISO 3251 (date: June 2019). This involves weighing out 1 g of sample into an aluminum dish which has been dried beforehand and drying the dish with sample in a drying cabinet at 130° C. for 60 minutes, cooling it in a desiccator, and then reweighing. The residue, relative to the total amount of sample employed, corresponds to the nonvolatile fraction.

4. ICP-OES

The amount of certain elements in a sample under analysis is determined using inductively coupled plasma atomic emission spectrometry (ICP-OES) according to DIN EN ISO 11885 (date: Sep. 1, 2009).

EXAMPLES

The following examples further illustrate the invention, but are not to be construed as limiting its scope.

1. Inventive and Comparative Lubricant Compositions

1.1 Example I1 (Comparative)

An acid stable aqueous polymeric lubricant composition I1 was prepared in a high-speed mixer with stirring. The composition of this lubricant is given in Table 1. It has a pH value of about 7.5.

TABLE 1

Composition of lubricant example I1

| Constituent | Amount [wt.-%] |
|---|---|
| Polymer 1 | 0.8 |
| Aqueous wax dispersion 1 (40 wt.-% solids) | 7.0 |
| Aqueous wax dispersion 2 (40 wt.-% solids) | 2.2 |
| Wax 3 | 0.6 |
| Defoamer | 0.1 |
| Corrosion inhibitor | 0.2 |
| Deionized water | 89.1 |
| | Σ 100.0 |

Polymer 1 is a polyvinyl pyrrolidone homopolymer having a weight average molecular weight of about 9.000 g/mol. A commercial product available from BASF SE has been used. Aqueous wax dispersion 1 contains a polypropylene wax, which is commercially available from BYK Chemie. Aqueous wax dispersion 2 contains a microcrystalline wax, which is commercially available from Michelman. Wax 3 is a montan wax, which is dispersible in aqueous medium. Butindiol has been used as corrosion inhibitor.

1.2 Example I2 (Inventive)

An acid stable aqueous polymeric lubricant composition I2 was prepared in a high-speed mixer with stirring. The composition of this lubricant is given in Table 2. It has a pH value of about 1.0.

TABLE 2

Composition of oxalate containing lubricant example I2

| Constituent | Amount [wt.-%] |
|---|---|
| Polymer 1 | 0.8 |
| Aqueous wax dispersion 1 (40 wt.-% solids) | 6.6 |
| Aqueous wax dispersion 2 (40 wt.-% solids) | 2.0 |
| Wax 3 | 0.6 |
| Defoamer | 0.1 |
| Corrosion inhibitor | 0.2 |
| Gardo ® Hybrid Z 4100 | 3.1 |
| Gardobond ® Additive H 7104 | 2.2 |
| Deionized water | 84.4 |
| | Σ 100.0 |

Polymer 1, aqueous wax dispersions 1 and 2, and wax 3 as well as the corrosion inhibitor have been described above in connection with lubricant example I1. Gardo® Hybrid Z 4100 is a commercially available oxalic acid containing product (Chemetall GmbH), which is free from phosphates. Gardobond® Additive H 7104 is a $Fe(NO_3)_3$ containing commercially available product from Chemetall GmbH and is used as an oxalating accelerator in combination with Gardo® Hybrid Z 4100.

The concentration of Gardo® Hybrid Z 4100 in I2 is 33 g/L and the concentration of Gardobond® Additive H 7104 in I2 is 23.6 g/L. The total acid (TA) value of I2 is 55.

1.3 Example I3 (Comparative)

An acid stable aqueous polymeric lubricant composition I3 was prepared in a high-speed mixer with stirring. The composition of this lubricant is given in Table 3. It has a pH value of about 7.5.

TABLE 3

Composition of lubricant example I3

| Constituent | Amount [wt.-%] |
|---|---|
| Polymer 1 | 0.3 |
| Aqueous polymer solution 2 (30 wt.-% solids) | 0.1 |
| Aqueous wax dispersion 1 (40 wt.-% solids) | 3.0 |
| Aqueous wax dispersion 4 (45 wt.-% solids) | 4.0 |
| Aqueous wax dispersion 2 (40 wt.-% solids) | 2.3 |
| Wax 3 | 0.6 |
| Polyglycol | 0.15 |
| Defoamer | 0.2 |
| Corrosion inhibitor | 0.15 |
| Deionized water | 89.2 |

Polymer 1 has been described above in connection with lubricant example I1. Aqueous polymer solution 2 contains a polyvinyl pyrrolidone copolymer, which is commercially available from BASF SE. Aqueous wax dispersions 1 and 2 and wax 3 as well as the corrosion inhibitor have been described above in connection with lubricant example I1. Aqueous wax dispersion 4 contains a polyethylene wax, which is commercially available from Münzing Chemie.

1.4 Example I4 (Inventive)

An acid stable aqueous polymeric lubricant composition I4 was prepared in a high-speed mixer with stirring. The composition of this lubricant is given in Table 4. It has a pH value of about 2.5.

TABLE 4

Composition of phosphate containing lubricant example I4

| Constituent | Amount [wt.-%] |
|---|---|
| Polymer 1 | 0.3 |
| Aqueous polymer solution 2 (30 wt.-% solids) | 0.1 |
| Aqueous wax dispersion 1 (40 wt.-% solids) | 2.7 |
| Aqueous wax dispersion 4 (45 wt.-% solids) | 3.6 |
| Aqueous wax dispersion 2 (40 wt.-% solids) | 2.1 |
| Wax 3 | 0.5 |
| Polyglycol | 0.1 |
| Defoamer | 0.2 |
| Corrosion inhibitor | 0.1 |
| Gardobond ® Z 3100 | 9.4 |
| Deionized water | 80.9 |
| | Σ 100.0 |

Polymer 1, aqueous polymer solution 2, aqueous wax dispersions 1, 2 and 4, and wax 3 as well as the corrosion inhibitor have been described above in connection with lubricant examples I1 and I3. Gardobond® Z 3100 is a commercially available phosphate containing product from Chemetall GmbH, which is used for zinc phosphating. The phosphating point (free acid (FA) plus Fischer total acid (TFA) of I4 is 20.

1.5 Example I5 (Inventive)

An acid stable aqueous polymeric lubricant composition I5 was prepared in a high-speed mixer with stirring. The composition of this lubricant is given in Table 5. It has a pH value of 1.0.

TABLE 5

Composition of oxalate containing lubricant example I5

| Constituent | Amount [wt.-%] |
|---|---|
| Polymer 1 | 0.3 |
| Aqueous polymer solution 2 (30 wt.-% solids) | 0.1 |
| Aqueous wax dispersion 1 (40 wt.-% solids) | 2.8 |
| Aqueous wax dispersion 4 (45 wt.-% solids) | 3.8 |
| Aqueous wax dispersion 2 (40 wt.-% solids) | 2.2 |
| Wax 3 | 0.6 |
| Polyglycol | 0.1 |
| Defoamer | 0.2 |
| Corrosion inhibitor | 0.1 |
| Gardo ® Hybrid 3100 | 3.1 |
| Gardobond ® Additive H 7104 | 2.2 |
| Deionized water | 84.5 |
| | Σ 100.0 |

Polymer 1, aqueous polymer solution 2, aqueous wax dispersions 1, 2 and 4, and wax 3 as well as the corrosion inhibitor have been described above in connection with lubricant examples I1 and I3. Gardo® Hybrid Z 4100 and Gardobond® Additive H 7104 have been described above in connection with lubricant example I2.

The concentration of Gardo® Hybrid Z 4100 in I5 is 33 g/L and the concentration of Gardobond® Additive H 7104 in I5 is 23.6 g/L. The total acid (TA) value of I5 is 55.

1.6 Example I6 (Comparative)

The commercially available product Gardomer® L 6332 from Chemetall GmbH has been used as comparative composition I6, which is an aqueous alkaline and wax containing polymeric lubricant. Gardomer® L 6332 has a pH value of 9.5 and is not stable in acid solution. In Gardomer® L 6332 an acid-functional copolymer is used as film-forming polymer, which is only soluble under alkaline conditions.

1.7 Example I7 (Comparative)

An acid stable aqueous polymeric lubricant composition I7 was prepared in the manner as described hereinbefore in item 1.2 in connection with inventive composition I2 with identical constituents in identical amounts with the exception that instead of polymer 1 a polyvinyl pyrrolidone homopolymer having a weight average molecular weight of 700.000 g/mol has been used.

2. Inventive and Comparative Method 2.1 Treatment with Acid Stable Aqueous Polymeric Lubricant I1 or I3 without Rinsing after an Oxalating Treatment in Two Steps (Comparative)

Wire sections with 11.0 mm diameter made of steel C15 (no. 1.0401) were used as steel workpieces (substrate S1) in the purpose of cold forming.

The workpieces were treated as follows:

The steel workpieces were dipped in a cleaning bath with a 50 g/L aqueous cleaning solution of Gardoclean® 351 available from Chemetall GmbH at 90° C. for 10 min. and then rinsed by cold tap water for 1 min. Afterwards, the surface purified workpieces were then pickled by using a 15 wt.-% HCl solution for 1 min. and subsequently rinsed by cold tap water for 1 min.

Next, in a first step the workpieces were subjected to an oxalating composition mixture using Gardo® Hybrid Z 4100 with Gardobond® Additive H 7104 as accelerator at 65° C. for 5 min. The total acid (TA) value of the mixture used was 55.

Then, in a second step, the workpieces were dipped into a bath containing lubricant example I1 or I3 at 85° C. for 5 min.

Finally, the coated workpieces obtained were then dried with air at 85° C.

2.2 Oxalating Treatment and Treatment with Acid Stable Aqueous Polymeric Lubricant I2 or I5 in a Single Step (Inventive) or with Lubricant Composition I7 in a Single Step (Comparative)

As metal workpieces the following substrates were used:

a) Sheet made of 0.8 mm cold-rolled steel (CRS) (DC05 (no. 1.0332); substrate S2),
b) Sheet made of 2.0 mm hot-rolled steel (HRS) (DC11 (no. 1.0332); substrate S3),
c) Slugs with 27 mm diameter and 13 mm height made of tempered steel (C15 (no. 1.0401); substrate S4) and,
d) Wire sections with 11.0 mm diameter made of steel (C15 (no. 1.0401); substrate S1).

Each of the workpieces was dipped in a cleaning bath with a 50 g/L aqueous cleaning solution of Gardoclean® 351 available from Chemetall GmbH at 90° C. for 10 min. and then rinsed by cold tap water for 1 min. Afterwards, the surface purified workpieces were then pickled by using a 15 wt.-% HCl solution for 1 min. and subsequently rinsed by cold tap water for 1 min.

Then, in a single step, the workpieces were dipped into a bath containing lubricant example I2 or I5 or I7 at 85° C. for 8 min.

Finally, the coated workpieces obtained were dried with air at 85° C.

No solid foams were formed during this process. The resulting sludge in the reaction bath of I2 or I5 or I7 was powdery and could be easily removed from the reaction bath.

2.3 Zinc-Phosphating Treatment and Treatment with Acid Stable Aqueous Polymeric Lubricant I4 in a Single Step (Inventive)

As metal workpieces the following substrates were used:

a) Sheet made of 2.0 mm hot-rolled steel (HRS) (DC11 (no. 1.0332); substrate S3),
b) Slugs with 27 mm diameter and 13 mm height made of tempered steel (C15 (no. 1.0401); substrate S4) and,
c) Wire sections with 11.0 mm diameter made of steel (C15 (no. 1.0401); substrate S1).

Each of the workpieces was dipped in a cleaning bath with a 50 g/L aqueous cleaning solution of Gardoclean® 351 available from Chemetall GmbH at 90° C. for 10 min. and then rinsed by cold tap water for 1 min. Afterwards, the surface purified workpieces were then pickled by using a 15 wt.-% HCl solution for 1 min. and subsequently rinsed by cold tap water for 1 min. The workpieces were then optimally activated by Gardolene® V 6522 available from Chemetall GmbH at room temperature for 1 min.

Then, in a single step, the workpieces were dipped into a bath containing lubricant example I4 at 60° C. for 10 min.

Finally, the coated workpieces obtained were dried with air at 85° C.

No solid foams were formed during this process. The resulting sludge in the reaction bath of I4 was powdery and could be easily removed from the reaction bath.

2.4 Treatment with a Conventional Alkaline Polymeric Lubricant I6 after Performance of (i) an Oxalating Treatment Followed by (ii) Rinsing in Two Steps (Plus Rinsing) (Comparative)

As metal workpieces the following substrates were used:

a) Sheet made of 0.8 mm cold-rolled steel (CRS) (DC05 (no. 1.0332); substrate S2), b) Wire sections with 11.0 mm diameter made of steel (C15 (no. 1.0401); substrate S1).

Each of the workpieces was dipped in a cleaning bath with a 50 g/L aqueous cleaning solution of Gardoclean® 351 available from Chemetall GmbH at 90° C. for 10 min. and then rinsed by cold tap water for 1 min. Afterwards, the surface purified workpieces were then pickled by using a 15 wt.-% HCl solution for 1 min. and subsequently rinsed by cold tap water for 1 min.

The workpieces were dipped into an oxalating bath containing commercial product Gardo® Hybrid Z 4100 and Gardobond® Additive H 7104 from Chemetall GmbH at 85° C. for 10 min. The total acid (TA) of this oxalating bath is 55, same as I2 and I5. Then the oxalated workpieces were rinsed with tap water for neutralization of the surface. After rinsing, the workpieces were dipped into a bath containing a conventional comparative aqueous alkaline lubricant I6 at 60° C. for 2 min.

Finally, the coated workpieces obtained were then dried with air at 85° C.

2.5 Treatment with a Conventional Alkaline Polymeric Lubricant I6 after Performance of (i) a Phosphating Treatment Followed by (ii) Rinsing in Two Steps (Plus Rinsing) I5 (Comparative)

As metal workpieces the following substrates were used:

a) Sheet made of 2.0 mm hot-rolled steel (HRS) (DC11 (no. 1.0332); substrate S3), b) Wire sections with 11.0 mm diameter made of steel (C15 (no. 1.0401); substrate S1).

Each of the workpieces was dipped in a cleaning bath with a 50 g/L aqueous cleaning solution of Gardoclean® 351 available from Chemetall GmbH at 90° C. for 10 min. and then rinsed by cold tap water for 1 min. Afterwards, the surface purified workpieces were then pickled by using a 15 wt.-% HCl solution for 1 min. and subsequently rinsed by cold tap water for 1 min. The workpieces were then optimally activated by Gardolene® V 6522 available from Chemetall GmbH at room temperature for 1 min.

The workpieces were dipped into a zinc-phosphating bath containing commercial product Gardobond® Z 3100 from Chemetall GmbH at 60° C. for 10 min. The phosphate point of this zinc-phosphating bath is 20, same as in case of lubricant I4. Then the zinc-phosphated workpieces were rinsed with tap water for neutralization of the surface. After rinsing, the workpieces were dipped into a bath containing a conventional comparative aqueous alkaline lubricant I6 at 60° C. for 2 min.

Finally, the coated workpieces obtained were then dried with air at 85° C.

3. Properties of the Coated Substrates

3.1 Coated Substrates Obtained from the 2-Step-Process as Outlined in Item 2.1 (Comparative)

The resulting coating layer on the workpiece obtained is homogenous, thick and adhered firmly on the treated surface of the workpiece. The top coating layer formed by the method is a polymer lubricant layer and the bottom coating layer formed is an oxalate coating layer. The coating weight on the substrate was determined using the following test method:

The lubricated workpiece was weighted. Then, the polymer lubricant coating layer was washed with xylene in order to detach it and subsequently with water. The workpiece was then dried and weighted. The oxalate coating layer was washed with an alkaline solution containing NaOH, triethyl amine and EDTA (PL 83 from Chemetall GmbH) in order to detach it. Finally, the workpiece was rinsed with water, dried and weighted once again.

The coating weights on wire (substrate S1) are given in Table 6. These data relate to the use of lubricant I1.

TABLE 6

Coating weight on coated steel wire surfaces (substrate S1) in g/m$^2$

| Substrate | Polymer lubricant coating weight [g/m$^2$] | Oxalate coating weight [g/m$^2$)] | Total coating weight [g/m$^2$] |
|---|---|---|---|
| S1 | 3.0 | 7.6 | 10.6 |

Drawing-tests of the coated substrate S1 were carried out to prove the cold forming performance with different drawing-speeds (two parallel runs I and II). The drawing test of run I was with 30 m/Min drawing-speed and 20% cross-sectional area reduction in each step. Run II was performed with 60 m/Min drawing-speed and 20% cross-sectional area reduction in each step. The results are displayed in Table 7. These data also relate to the use of lubricant I1.

TABLE 7

Test parameters of drawing-performance of coated substrates S1

| | Run I (30 m/Min) | Run II (60 m/Min) |
|---|---|---|
| 1. Draw | Ø(11 mm) to Ø(9.8 mm) | Ø(11 mm) to Ø(9.8 mm) |
| 2. Draw | Ø(9.8 mm) to Ø(8.8 mm) | Ø(9.8 mm) to Ø(8.8 mm) |
| 3. Draw | Ø(8.8 mm) to Ø(7.8 mm) | Ø(8.8 mm) to Ø(7.8 mm) |

Both parallel runs showed good drawing performance. The coating layer on substrate S1 showed very good lubricating properties. In addition, the coating layers showed a very good stability against corrosion. After drawing a homogenous coating layer still existed on the wire surface and the steel wire substrate S1 showed no scratches or other visible imperfections on its steel surface. The remaining polymer lubricant coating weight and oxalate coating weight are listed in Table 8. The polymer lubricant coating has a good lubricating performance and is thus suitable for metal cold forming with high speed drawing. These data also relate to the use of lubricant I1.

TABLE 8

Remaining coating weights of coated substrate S1 after drawing

| | Polymer lubricant coating weight [g/m$^2$] | Oxalate coating weight [g/m$^2$] | Total [g/m$^2$] |
|---|---|---|---|
| Run I | 1.6 | 6.4 | 8.0 |
| Run II | 1.2 | 5.5 | 6.7 |

achieved with I2 and the one-step method, whereas for substrate S1 a total coating weight of only 10.6 g/m$^2$ was achieved with I1 and the two-steps method.

Drawing-tests of the coated substrate S1 were carried out to prove the cold forming performance with different drawing-speeds (three parallel runs I and II and III). The results are displayed in Table 10. The drawing test of run I was with 30 m/Min drawing-speed and 20% cross-sectional area reduction in each step. Run II was performed with 60 m/Min drawing-speed and 20% cross-sectional area reduction in each step. Run III was performed with 40 m/Min drawing-speed and 35% cross-sectional area reduction in each step. These data also relate to the use of lubricant I2.

TABLE 10

Test parameters of drawing-performance of coated substrate S1

| | Run I (30 m/Min) | Run II (60 m/Min) | Run III (40 m/Min) |
|---|---|---|---|
| 1. Draw | Ø(11 mm) to Ø(9.8 mm) | Ø(11 mm) to Ø(9.8 mm) | Ø(11 mm) to Ø(8.5 mm) |
| 2. Draw | Ø(9.8 mm) to Ø(8.8 mm) | Ø(9.8 mm) to Ø(8.8 mm) | Ø(8.5 mm) to Ø(7.4 mm) |
| 3. Draw | Ø(8.8 mm) to Ø(7.8 mm) | Ø(8.8 mm) to Ø(7.8 mm) | nd |
| 4. Draw | Ø(7.8 mm) to Ø(6.7 mm) | Ø(7.8 mm) to Ø(6.7 mm) | nd |

nd = not determined

3.2 Coated Substrates Obtained from the 1-Step-Process as Outlined in Item 2.2 (Inventive in Case of I2 and I5 and Comparative in Case of I7)

3.2.1 Coated Substrates Obtained from Making Use of I2 and I5 (Inventive)

The resulting coating layer on each of the coated workpieces is homogenous, thick and adhered firmly on the treated surface of each workpiece. The coating layers showed a very good stability against corrosion, and no brown discoloration existed on any of the steel surfaces. The top coating layer formed by the method is a polymer lubricant layer and the bottom coating layer formed is an oxalate coating layer.

The resulting coating weights are determined using the same test method as described above in item 3.1.

The coating weights on the different substrates were determined by the method described hereinbefore in item 3.1 and are listed in Table 9. These data relate to the use of lubricant I2.

TABLE 9

Coating weights on different substrate surfaces (S1, S2, S3 and S4) in g/m$^2$

| | Polymer lubricant coating weight [g/m$^2$] | Oxalate coating weight [g/m$^2$)] | Total [g/m$^2$] |
|---|---|---|---|
| S2 | 5.0 | 4.6 | 9.6 |
| S3 | 6.9 | 7.7 | 14.6 |
| S1 | 6.3 | 7.8 | 14.1 |
| S4 | 9.0 | 12.5 | 21.5 |

As it evident from Table 9 in comparison with Table 6 significantly higher coating weights could be obtained by making use of the one-step method using lubricant I2 compared to the two-steps-method using lubricant I1: for substrate S1 a total coating weight of 14.1 g/m$^2$ was All three parallel runs showed good drawing performance. The coating layer on steel wire showed very good lubricating properties. After drawing a homogenous coating layer still existed on the wire surface and the steel wire showed no scratches or other visible imperfections on steel surface.

The remaining coating weights after having performed the drawing test are listed in Table 11. After drawing, the total remaining coating weights are all still higher than 6 g/m$^2$. The steel wires could even still be drawn to reduce the diameter. These data also relate to the use of lubricant I2.

TABLE 11

Remaining coating weights of coated substrate S1 after drawing

| | Polymer lubricant coating weight [g/m$^2$] | Oxalate coating weight [g/m$^2$] | Total coating weight [g/m$^2$] |
|---|---|---|---|
| Run I | 3.2 | 3.8 | 7.0 |
| Run II | 3.4 | 5.2 | 8.6 |
| Run III | 2.7 | 3.6 | 6.3 |

Coated substrate S4 was cold extruded. The cold extrusion was successful. No scratches or other visible imperfection existed on the cold extruded substrates.

The coatings have proven to have a high quality and to be very suitable for cold forming with high drawing speeds and for cold extrusion. The remaining coating layers adhered still firmly on the metal surface of the substrates.

After the cold forming process, the remaining coating layer can be washed using alkaline cleaner, e.g. Gardoclean® S 5171 with Gardobond® Additive H 7375 from Chemetall GmbH, or with acidic cleaner, e.g. Gardobond® Additive H 7132 with Gardobond® Additive H 7390 from Chemetall GmbH, without impairing any of the desired properties.

3.2.2 Coated Substrates Obtained from Making Use of I7 (Comparative)

The resulting coating layer on each of the coated workpieces is homogenous, thick and adhered firmly on the treated surface of each workpiece in case I7 was used. However, in contrast to I2 and I5 in case of comparative lubricant I7, only inferior lubricating properties were observed as the coating obtained from I7 showed a significant undesired tackiness. In addition, after drawing undesired scratch was observed on the surface obtained from I7. The coating obtained from I7 has thus been proven to not be suitable for cold forming with high drawing speeds and for cold extrusion.

3.3 Coated Substrates Obtained from the 1-Step-Process as Outlined in Item 2.3 (Inventive)

The resulting coating layer on each of the coated workpieces is homogenous, thick and adhered firmly on the treated surface of each workpiece. The coating layers showed a very good stability against corrosion, and no brown discoloration existed on any of the steel surfaces. The top coating layer formed by the method is a polymer lubricant layer and the bottom coating layer formed is a zinc phosphate coating layer.

The coating weights on the different substrates were determined by the method described hereinbefore in item 3.3 and are listed in Table 12.

TABLE 12

Coating weights on different substrate surfaces (S1, S3 and S4) in g/m$^2$

| Substrate | Polymer lubricant coating weight [g/m$^2$] | Zinc-phosphate coating weight [g/m$^2$)] | Total [g/m$^2$] |
|---|---|---|---|
| S3 | 2.7 | 8.0 | 10.7 |
| S4 | 5.0 | 8.7 | 13.7 |
| S1 | 2.9 | 8.1 | 11.0 |

Drawing-tests of the coated substrate S1 were carried out to prove the cold forming performance with different drawing-speeds (three parallel runs I and II and III). The results are displayed in Table 13. The drawing test of run I was with 30 m/Min drawing-speed and 20% cross-sectional area reduction in each step. Run II was performed with 60 m/Min drawing-speed and 20% cross-sectional area reduction in each step.

TABLE 13

Test parameters of drawing-performance of coated substrates S1

| | Run I (30 m/Min) | Run II (60 m/Min) |
|---|---|---|
| 1. Draw | Ø(11 mm) to Ø(9.8 mm) | Ø(11 mm) to Ø(9.8 mm) |
| 2. Draw | Ø(9.8 mm) to Ø(8.8 mm) | Ø(9.8 mm) to Ø(8.8 mm) |
| 3. Draw | Ø(8.8 mm) to Ø(7.8 mm) | Ø(8.8 mm) to Ø(7.8 mm) |

Both parallel runs showed good drawing performance. The coating layer on substrate S1 showed very good lubricating properties. In addition, the coating layers showed a very good stability against corrosion. After drawing a homogenous coating layer still existed on the wire surface and the steel wire substrate S1 showed no scratches or other visible imperfections on its steel surface. The remaining polymer lubricant coating weight and oxalate coating weight are listed in Table 14. The polymer lubricant coating has a good lubricating performance and is thus suitable for metal cold forming with high speed drawing.

TABLE 14

Remaining coating weights of coated substrate S1 after drawing

| | Polymer lubricant coating weight [g/m$^2$] | Oxalate coating weight [g/m$^2$] | Total [g/m$^2$] |
|---|---|---|---|
| Run I | 1.0 | 3.9 | 4.9 |
| Run II | 0.7 | 2.8 | 3.5 |

Coated substrate S4 was cold extruded. The cold extrusion was successful. No scratches or other visible imperfection existed on the cold extruded substrates.

The coatings have proven to have a high quality and to be very suitable for cold forming with high drawing speeds and for cold extrusion. The remaining coating layers adhered still firmly on the metal surface of the substrates.

After the cold forming process, the remaining coating layer can be washed using alkaline cleaner, e.g. Gardoclean® S 5171 with Gardobond® Additive H 7375 from Chemetall GmbH, or with acidic cleaner, e.g. Gardobond® Additive H 7132 with Gardobond® Additive H 7390 from Chemetall GmbH, without impairing any of the desired properties.

3.4 Comparing Coated Substrates Obtained from Inventive 1-Step Process as Outlined in Item 2.2 (Making Use of I2 or I5) with Coated Substrates Obtained from a Conventional Multi-Step Process as Outlined in Item 2.4, which Make Use of Alkaline Lubricants, and with Coated Substrates Obtained from a Comparative 1-Step Process as Outlined in Item 2.2 (Making Use of I7)

The coated substrates obtained from the 1-step process as outlined in item 2.2 and making use of I2 or I5 showed good lubricating properties and a good stability against corrosion. The coating properties obtained from 1-step process as outlined in item 2.2 and making use of I2 or I5 are comparable or slightly better than coating obtained from conventional multi-step process at outlined in item 2.4. However, only one process step has to be performed in case of the inventive method and thus no rinsing step is necessary as in case of the comparative method and the total coating weights obtained in case of the inventive 1-step method are higher than in case of the comparative 2-steps method. The coated substrate obtained from the 1-step process as outlined in item 2.2 and making use of I7, however, did not show good lubricating properties and was found to be unsuitable for a subsequent cold forming process.

3.5 Comparing Coated Substrates Obtained from Inventive 1-Step Process as Outlined in Item 2.3 with Coated Substrates Obtained from a Conventional Multi-Step Process as Outlined in Item 2.5, which Make Use of Alkaline Lubricants The coated substrates obtained from the 1-step process as outlined in item 2.3 showed good lubricating properties and a good stability against corrosion. The coating properties obtained from 1-step process as outlined in item 2.2 are comparable or slightly better than coating obtained from conventional multi-step process at outlined in item 2.5. However, only one process step has to be performed in case of the inventive method and thus no rinsing step is necessary as in case of the comparative method and the total coating weights obtained in case of the inventive 1-step method are higher than in case of the comparative 2-steps method.

The invention claimed is:

1. A method for pretreatment of a metallic substrate for a subsequent metal cold forming process, said method comprising at least steps (1) and (2) and optionally step (3), (1) providing at least one substrate having at least one surface at least partially made of at least one metal, (2) contacting the at least one surface of the substrate provided in step (1) with an aqueous lubricant composition (B) having a pH value in the range of from 0.1 to below 2.0, wherein the aqueous lubricant composition (B) comprises, in addition to water, which is present in composition (B) in an amount of at least 40 wt.-%, based on the total weight of composition (B):

(b1) at least one film-forming polymer, which is a homopolymer and/or copolymer being prepared by polymerization of at least vinyl pyrrolidone as at least one monomer, wherein said homopolymer and/or copolymer has a weight average molecular weight in the range of from 1,000 to 100,000 g/mol, (b2) at least one wax, which is different from constituent (b1), (b3) at least one corrosion inhibitor, which is different from both constituents (b1) and (b2), and (b4) oxalate anions and not any phosphate anions and (3) optionally drying the coating film obtained after having performed step (2).

2. The method according to claim 1, wherein the film-forming polymer constituent (b1) has a weight average molecular weight in the range of from 5,000 to 100,000 g/mol.

3. The method according to claim 1, wherein the aqueous lubricant composition (B) has a pH value in the range of from 0.5 to below 2.0.

4. The method according to claim 1, wherein the at least one surface of the substrate is at least partially made of steel.

5. The method according to claim 1, wherein step (2) is performed by at least partially dipping the substrate into a bath containing the aqueous lubricant composition (B) having a bath temperature in the range of from 20 to 95° C.

6. The method according to claim 1, wherein the at least one film-forming polymer (b1) is a homopolymer prepared from vinyl pyrrolidone or a copolymer prepared from vinyl pyrrolidone and at least from at least one monomer selected from the group consisting of vinyl amine, vinyl alcohol, vinyl formamide, vinyl caprolactam, vinyl acetate and vinyl imidazole.

7. The method according to claim 1, wherein the at least one film-forming polymer (b1) is present in the composition (B) in an amount in the range of from 0.05 to 20 wt.-% based on the total weight of the composition (B).

8. The method according to claim 1, wherein the at least one wax (b2) is selected from the group consisting of polyolefin waxes, paraffin waxes and natural waxes, and mixtures thereof.

9. The method according to claim 1, wherein the at least one wax (b2) is present in the composition (B) in an amount in the range of from 0.1 to 20 wt.-% based on the total weight of the composition (B).

10. A pretreated metallic substrate obtained by the method according to claim 1.

11. The pretreated metallic substrate according to claim 10, wherein the coating film present on the surface of the substrate after having performed step (3) has a coating weight in a range of from 1.0 to 40.0 $g/m^2$.

12. A method of cold forming a metallic substrate comprising a step of subjecting the pretreated metallic substrate according to claim 10 to a cold forming process.

13. An aqueous lubricant composition (B) as defined in claim 1.

14. A master batch to produce the aqueous composition (B) according to claim 13 by diluting the master batch with water and if applicable by adjusting the pH value.

15. The method according to claim 1, wherein the film-forming polymer constituent (b1) has a weight average molecular weight in the range of from 5,000 to 75,000 g/mol.

16. The method according to claim 1, wherein the substrate is made of steel.

17. The method according to claim 1, wherein step (2) is performed by at least partially dipping the substrate into a bath containing the aqueous lubricant composition (B) having a bath temperature in the range of from 30 to 90° C.

18. The method according to claim 1, wherein step (2) is performed by at least partially dipping the substrate into a bath containing the aqueous lubricant composition (B) having a bath temperature in the range of from 45 to 85° C.

19. The method according to claim 1, wherein the at least one film-forming polymer (b1) is present in the composition (B) in an amount in the range of from 0.10 to 15 wt.-% based on the total weight of the composition (B).

20. The method according to claim 1, wherein the film-forming polymer constituent (b1) has a weight average molecular weight in the range of from 1,000 to 50,000 g/mol.

* * * * *